US006989728B2

(12) United States Patent
Van Zeeland et al.

(10) Patent No.: US 6,989,728 B2
(45) Date of Patent: Jan. 24, 2006

(54) FLEXIBLE MAGNETICALLY COUPLED PUSHBUTTON SWITCH

(75) Inventors: Anthony J. Van Zeeland, Mesa, AZ (US); Steven Yale Shepard, Chandler, AZ (US)

(73) Assignee: Duraswitch Industries, Inc., Mesa, AZ (US)

( * ) Notice: Subject to any disclaimer, the term of this patent is extended or adjusted under 35 U.S.C. 154(b) by 36 days.

(21) Appl. No.: 10/683,618

(22) Filed: Oct. 14, 2003

(65) Prior Publication Data

US 2005/0077988 A1 Apr. 14, 2005

(51) Int. Cl.
*H01H 9/00* (2006.01)

(52) U.S. Cl. ..... 335/205; 200/512

(58) Field of Classification Search ..... 335/205–207; 200/511–512, 520–521

See application file for complete search history.

(56) References Cited

U.S. PATENT DOCUMENTS 4,513,271 A * 4/1985 Reisem ..... 335/205

5,243,162 A * 9/1993 Kobayashi ..... 200/512

* cited by examiner

*Primary Examiner*—Lincoln Donovan

(74) *Attorney, Agent, or Firm*—The Hill Law Firm PLC; Scott A. Hill

(57) ABSTRACT

A flexible magnetically coupled pushbutton switch assembly has a coupler layer magnetically held against a flexible layer that has flaps that function as flexible armatures. The flexible armatures are normally magnetically coupled to the coupler layer. The coupler layer is a sheet of magnetic receptive rubber material that includes debossed spacers, and there are embossed crowns in the flexible armatures. The embossed crowns fit into openings in the coupler layer so that a switch user may manipulate the flexible armatures. The debossed spacers support the flexible layer above a bottom layer such that there are armature cavities for the flexible armatures. An arrangement of electrical conductors is affected when a switch user selectively manipulates a flexible armature so that an electrical circuit connected to the electrical switch is opened or closed when the switch is actuated.

8 Claims, 3 Drawing Sheets

FLEXIBLE MAGNETICALLY COUPLED PUSHBUTTON SWITCH

BACKGROUND OF THE INVENTION

While pushbutton switches with magnetically coupled armatures already have many applications, cost per switch is higher than many membrane switches. The major expenses of a magnetically coupled pushbutton switch are the cost of stamping and plating armatures and the cost of aligning and adhering the numerous switch layers. A major selling point of a magnetically coupled pushbutton switch is long life, but in our disposable society that is not of great interest to many manufacturers. The present invention is a magnetically coupled pushbutton switch that is flexible, is inexpensive to make, and has no small piece parts that need to be individually aligned.

Magnetically coupled switches of the prior art, exemplified in FIGS. 1–4, normally have an electrically conductive armature 2 that is magnetically held by a coupler magnet layer 4 in a rest position, as in FIG. 1, spaced from switch contacts 6 on a non-conductive substrate layer 8. A user-provided actuation force applied to a crown 10 of the electrically conductive armature (usually stamped sheet metal that is silver plated) causes it to snap free of the coupler magnet layer and close the switch contacts by electrically connecting them. Withdrawal of the actuation force allows the coupler magnet layer to attract the electrically conductive armature back to the rest position, resulting in a reopening of the switch. A non-conductive spacer layer 12 (such as high density foam) is adhesively fixed to the substrate layer, with a cavity 14 in the spacer layer exposing the switch contacts. The coupler magnet layer overlies the spacer layer. The electrically conductive armature is magnetically coupled to the bottom of the coupler magnet layer so that the electrically conductive armature is housed within the cavity in the spacer layer. The armature's crown protrudes through an aperture 16 in the coupler magnet layer. Typically, a polyester membrane layer 18 with suitable graphics overlies the coupler magnet layer to seal the switch and to direct a user of the switch as to location and function of the switch.

Magnetically coupled pushbutton switches of the prior art, as shown and described in U.S. Pat. Nos. 5,523,730, 5,990,772, 6,262,646, and 6,556,112, incorporated herein by reference but not limitation, all have an electrically conductive armature piece-part that can travel through a unique pivot/click (FIG. 2/FIG. 3) movement designed to create a very distinct tactile feedback to a switch user. FIG. 2 shows that application of an actuation force 20 causes a heel 22 of the electrically conductive armature to break away from the coupler magnet layer 4 and travel to the substrate layer 8 where in the heel stops (creating a first tactile feedback) and functions as a fulcrum for the electrically conductive armature. FIG. 3 shows that continued application of the actuation force causes a toe 26 of the electrically conductive armature to abruptly break away from the coupler magnet layer so that the toe contacts the substrate layer (creating a second tactile feedback). The exploded view in FIG. 4 shows five layers. An additional four layers of adhesive are needed to hold the assembly together. Some of the assemblies described in the prior art have as many as thirteen layers, including adhesive layers. The armatures shown in FIG. 4 must be individually aligned and placed so that the crowns 10 properly seat within the apertures 16. There is a great need to eliminate switch layers and adhesive layers, as well as a need to simplify alignment of armatures.

Alternatively, the momentary contact magnetic switches shown and described in U.S. Pat. No. 4,513,271 have a flexible magnet armature that breaks away from a steel faceplate to create two distinct switch functions. Such an armature design could be combined with the magnetically coupled pushbutton switch assembly described above, but there would still be a substantial cost to align/position the armatures, which are small magnets that will stick to every magnetic material they contact, such as other small magnets. Additionally, there would still be a need for adhesive layers, a foam spacer layer, and the projections shown and described in U.S. Pat. No. 4,513,271 would need to be used because sheet magnet armatures crack and break when there is an attempt to stamp a crown into the sheet magnet.

SUMMARY OF THE INVENTION

The present invention is a low cost, easy to make pushbutton switch assembly that integrates structure and performance into a single magnetic flexible layer that is continuous with at least one flexible armature, hundreds if desired, that are cut into the magnetic flexible layer. This single magnetic flexible layer may be formed so that it contains an array of flexible armatures, which are flaps of the layer, that have free ends and fixed ends. The armatures of the prior art have several drawbacks that are not present in the unique structure of the present invention. For example, the new flexible armatures do not need to be individually assembled and aligned, are substantially impervious to abuse, and the preferred materials cannot rust or corrode. There are several characteristics of the flexible armatures that expand the applications of a switch of the type having a magnetically coupled armature. Perhaps the most important application of the switch of the present invention is as an alternative to rubber dome switches, which are commonly used in handheld devices such as phones. Like rubber domes, the switch of the present invention is compact, inexpensive, and abuse resistant. The prior art magnetically coupled pushbutton switches have been a suitable alternative to metal domes, not rubber domes. Also, it should be noted that the pivot/click motion of some of the prior art has been eliminated, so there is no double tactile feedback in the switch of the present invention.

In the preferred embodiment of the present invention, "magnetic receptive rubber" is formed into a magnetic flexible layer that has flexible armatures cut into the layer. The flexible armatures have embossed crowns, and debossed spacers are formed in the magnetic flexible layer surrounding each flexible armature. The magnetic flexible layer is sandwiched between a magnetic coupler layer and a bottom layer. The resulting assembly allows each flexible armature, except at a fixed end that remains continuous with the rest of the magnetic flexible layer, to travel out of the plane of the magnetic flexible layer. That part of the flexible armature that is closest to the fixed end functions as a flexible fulcrum that allows the flexible armature to be manipulated from the magnetic coupler layer to the bottom layer. Magnetic attractive forces normally hold the magnetic coupler layer in coupled engagement with the magnetic flexible layer and flexible armatures, so there is no need to adhesively fix these layers.

DETAILED DESCRIPTION OF THE INVENTION

Figure 1:
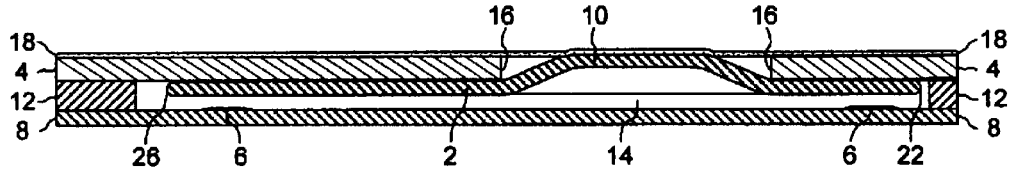
Fig. 1 Prior Art
FIG. 1 is a cross-section of a prior art magnetically coupled pushbutton switch in the rest position.
Figure 2:
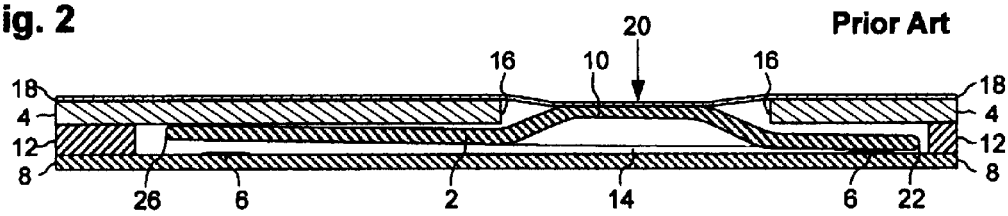
Fig. 2 Prior Art
FIG. 2 is a cross-section of the switch of FIG. 1 in a partially actuated position, with the heel of the armature acting as a fulcrum.
Figure 3:
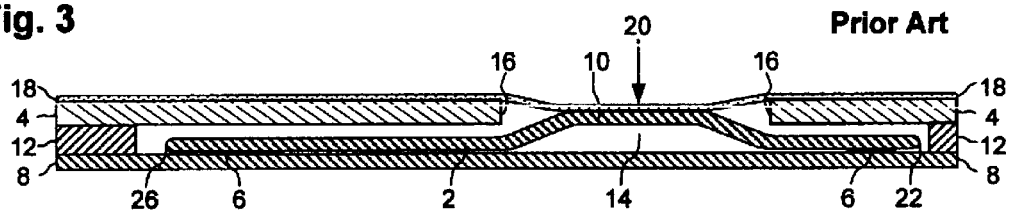
Fig. 3 Prior Art
FIG. 3 is a cross-section of the switch of FIG. 1 in the fully actuated position.
Figure 4:
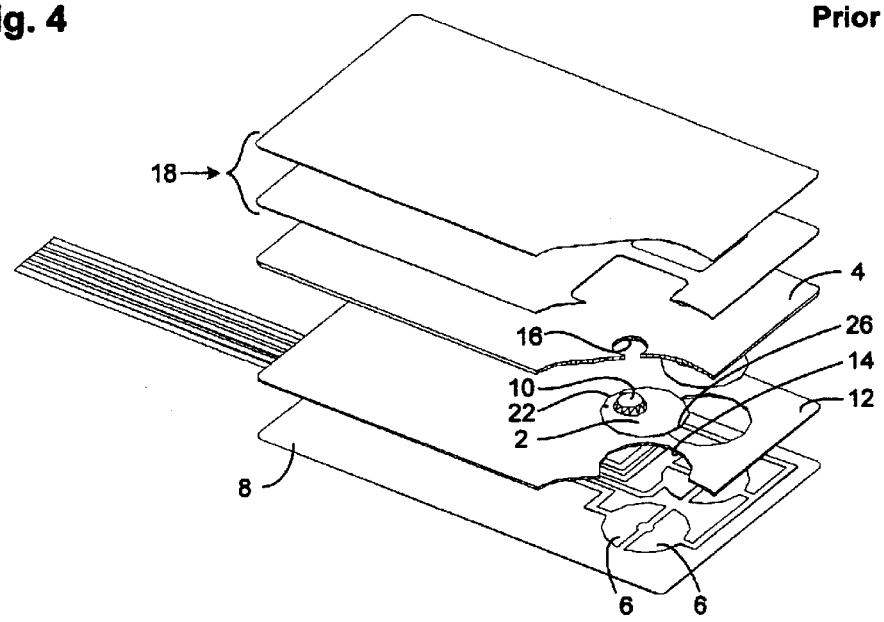
Fig. 4 Prior Art
FIG. 4 is an exploded perspective view of prior art magnetically coupled pushbutton switches.

Throughout this description, where parts do not substantially change from one embodiment to another the same numbers will carry the same meaning. The several embodiments at least include: a magnetic coupler layer 30 having an opening 38; a magnetic flexible layer 32 having a flexible armature 40; a magnetic attractive force between the magnetic coupler layer and the magnetic flexible layer; a magnetic attractive force between the magnetic coupler layer and the flexible armature such that they are normally magnetically coupled; an actuation member that is capable of passing through the opening such that the flexible armature may be manipulated by a switch user; a bottom layer 36; a spacer means that supports the magnetic flexible layer above the bottom layer such that there is an armature cavity 52 for the flexible armature; and an arrangement of electrical conductors 54 that enables a switch user to selectively manipulate electrical circuits connected to the electrical switch such that actuation electrically opens or electrically closes a specific electrical circuit.

Typically, electrical leads connect the electrical conductors 54 to electronics that are external to the switch. To reduce cost, it is recommended that the switch of the present invention be formed as an assembly of switch layers, and numerous pushbutton switches may be formed in a single assembly. In the most preferred embodiment, the magnetic flexible layer 32 includes numerous debossed spacers 34, and each flexible armature 40 includes an embossed crown 50. For a normally open switch, the magnetic flexible layer overlies a circuit layer, such as a flex circuit or a printed circuit board, so that the debossed spacers support flexible armatures in a position spaced above the electrical conductors that are electrically connected when a switch user actuates the flexible armature There are several additional features shown and described in the foregoing description that may be modified or excluded where cost or preference dictates otherwise. Preferred materials, shapes, methods of attachment and methods of assembly will be discussed, but these preferences are not intended to exclude suitable or functionally equivalent alternatives. Also, described features that are commonly made by a described process are only suggestive and do not preclude other known methods of making the same feature, so an "embossed" feature could be formed by injection molding or extruding the feature. As used herein, the term "switch" includes devices for closing, opening, or changing the connections in an electrical circuit; the term "magnetic material" means a magnet or a material that is affected by a magnet; the term "electrical conductor" includes electrodes, resistor elements, electrical wires, and spaced electrical contacts or pads; and the term "top" refers to that surface of any part in a cross sectional figure of the drawings that faces the top edge of the page, while "bottom" refers to that surface of any part in a cross sectional figure of the drawings that faces the bottom edge of the page.

Figure 5:
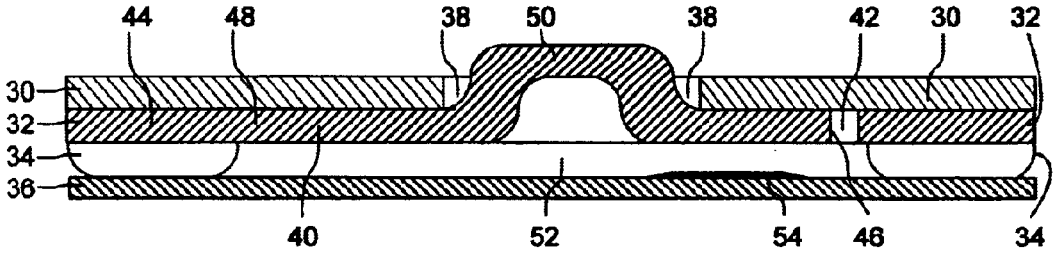
FIG. 5 is a cross section, including the magnetic flexible layer through line 7—7 of FIG. 7, of a flexible magnetically coupled pushbutton switch of the present invention in the rest position.
Figure 6:
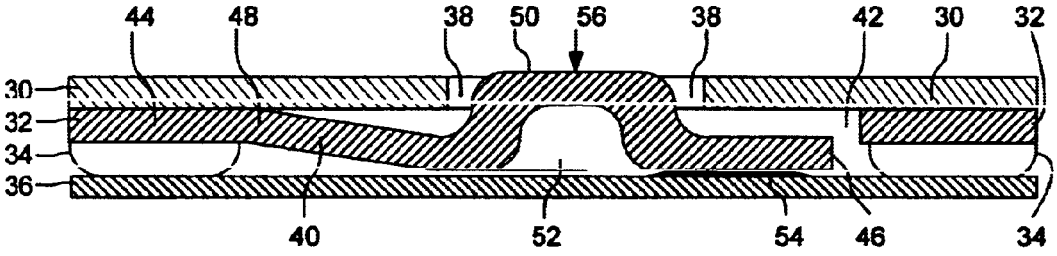
FIG. 6 is the switch of FIG. 5 shown in the fully actuated position.
Figure 7:
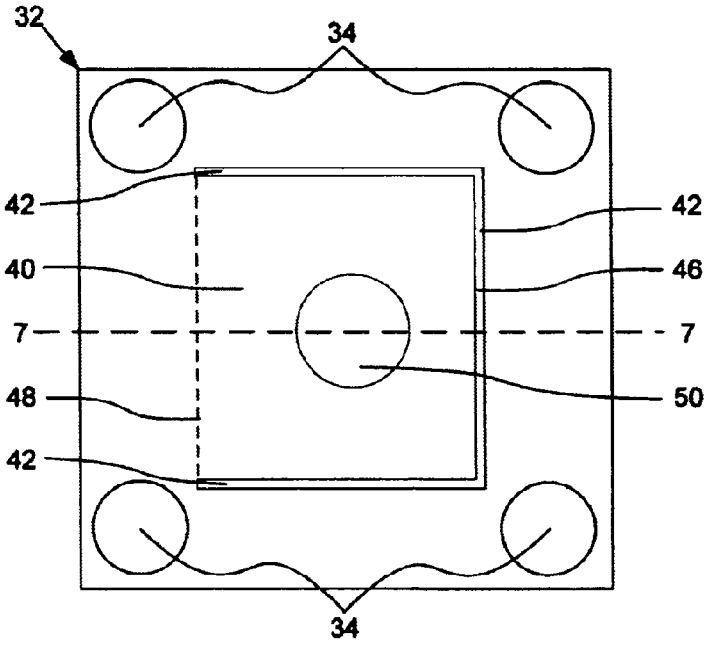
FIG. 7 is a plan view of the magnetic flexible layer used in FIGS. 5 and 6.

The most preferred embodiment, shown in FIGS. 5–7, uses a "magnetic receptive rubber" material to make the magnetic flexible layer 32. For our purposes, magnetic receptive rubber is any rubber-like material impregnated with ferrite, or otherwise made to be magnetically attracted to a magnet, and it usually has no residual magnetic field when it is removed from a magnet. Examples of magnetic receptive rubber include the magnetic material made by Flexmag Industries, Inc. under the trade name Ferrosheet™ and the magnetic material made by Magnum Magnetics Corporation under the trade name Rubber Steel®. It is possible, but not recommended, to substitute sheet magnet that has a thin layer of polyester, or other durable material, adhered to the bottom surface of the sheet magnet. However, the preferred magnetic receptive rubber is easy to cut, so the flaps that serve as flexible armatures 40 are easy to make, and magnetic receptive rubber is ideal for forming debossed spacers 34 and embossed crowns 50 that are well defined.

Figure 8:
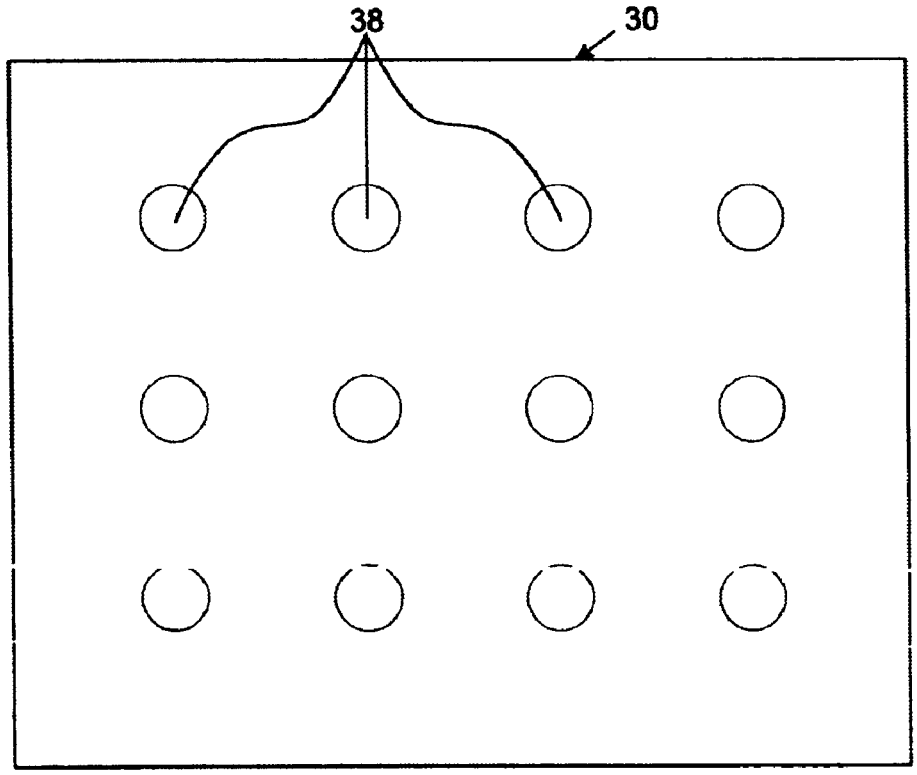
FIG. 8 is a plan view of a magnetic coupler layer for use in a device that uses numerous flexible magnetically coupled pushbutton switches.

The magnetic coupler layer 30, made from a magnetic material, is most preferably a sheet of permanent magnet material, such as extruded, calendered or molded magnet that has a uniform thickness and has a substantially flat bottom surface. Barium ferrite bonded sheet magnet is currently one of the cheapest materials that is suitable for making a magnetic coupler layer, which is most cost effectively just another layer of the switch assembly. A plan view of the magnetic coupler layer as it might look in a twelve-switch assembly, such as for a calculator, is shown in FIG. 8. Neodymium Iron Boron (NdFeB) and Samarium Cobalt (SmCo5) are suitable materials for use with more compact switch designs that require a stronger magnetic holding force. A significant benefit of using extruded or calendered sheet magnet is that they may be easily machined or blade cut to the correct size and shape, thereby reducing manufacturing costs. Alternatively, if the sheet magnet is used to make the magnetic flexible layer 32, the magnetic coupler layer may be made from magnetic receptive rubber or other material that is magnetically attracted to a permanent magnet. It is highly recommended that the magnetic coupler material be substantially impervious to any permanent deformities if subjected to abuses of the kind that are familiar to the switch industry.

There is an opening 38 in the magnetic coupler layer 30 that is just large enough to allow an actuation member to pass freely through the opening. The opening may simply be blade cut or stamped into the magnetic coupler. There are numerous available actuation members that could be used in place of what is shown and described in the several embodiments, but the most preferred actuation member is an embossed crown 50, shown in FIGS. 5, 6, 7 and 9. The shape and size of the actuation member may be adjusted to accommodate aesthetics and ergonomics, but a smaller opening tends to perform better and limits the ingress of debris.

The magnetic flexible layer 32, when ready for assembly, magnetically attaches to the bottom of the magnetic coupler layer 30. At least one flexible armature 40 is cut out, or otherwise formed in the magnetic flexible layer, to create a flap that will lie at least partially below the opening 38 in the magnetic coupler layer. The flap is, substantially, the flexible armature. The only part of the magnetic flexible layer that is normally movable with respect to the magnetic coupler layer is the flexible armature. The flexible armature is, however, normally magnetically attracted into coupled engagement with the magnetic coupler layer such that the flexible armature is normally spaced from normally open electrical conductors 54 of the switch, or normally pressing against normally closed electrical conductors of the switch.

To provide a uniform magnetic attractive force and limit the size of a switch assembly, the flexible armature 40 is most preferably made from a flat material and has a rectangular shape. Numerous other shapes will also work, but we will focus on a rectangular shape because it is the most preferred. To create a flap in the magnetic flexible layer 32, only three of the four sides of the rectangle are cut. The remaining un-cut side is the fixed end 44 of the flexible armature. The side opposite the fixed end is the free end 46. That part of the flexible armature that is nearest the fixed end is the most likely to bend if the free end is forced away from the bottom of the magnetic coupler. Where the flexible armature naturally wants to bend is the flexible fulcrum 48. The free end is, therefore, the side of the flexible armature that is capable of traveling the farthest from the magnetic coupler layer. For most flexible armature shapes, the actuation member should be located closer to the free end than the fixed end. If binding is a concern with a particular material, it may be necessary to make, during a cutting process, an armature perimeter channel 42 that is created if a small amount of material is removed along the cut sides of the flexible armature.

Figure 9:
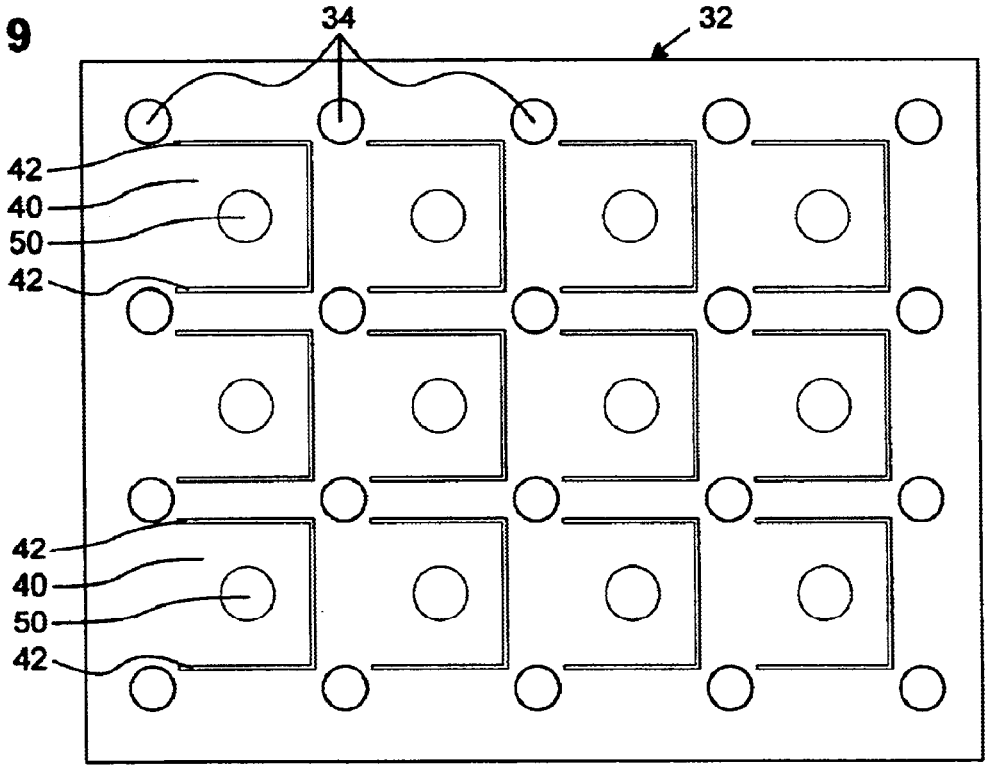
FIG. 9 is a plan view of a magnetic flexible layer that would be used with the magnetic coupler layer of FIG. 8.

There are many ways that a flexible armature 40 may be cut out, such as by laser cutting, rule die cutting, matched metal die cutting or water jet cutting. If a die cutting method is used, then the magnetic flexible layer 32 should be cut before any embossing/debossing process is performed. As shown in FIG. 9, it is anticipated that numerous switches will be formed into a single magnetic flexible layer. The overall size of the magnetic flexible layer to be used for a particular application may be cut at the same time that the numerous individual flexible armatures are cut. Material may be removed during the cutting process to form defined armature perimeter channels 42. If a thin layer of durable material is going to be used on the bottom of the magnetic flexible layer, it should be applied before the cutting process is performed.

A spacer means is preferably debossed into the magnetic flexible layer 32, such as with high pressure at low heat, at locations that are exterior to the perimeter of each flexible armature 40. For multiple switch configurations, debossed spacers 34 are ideally located off the corners of each flexible armature, as shown in FIG. 9. Where there is substantial distance between pushbutton switches, a pattern of debossed spacers (such as a waffle pattern, a pattern of dots, or a pattern of bars) may be formed in the magnetic flexible layer so that a switch assembly has a uniform thickness. Also, the embossed crowns 50 can be formed using the same method so that there is only one embossing/debossing process. After assembly, the bottom of the debossed spacers will rest on the bottom layer 36 such that an armature cavity 52 is defined. Alternatively, a spacer means may be formed into a layer or a part that is below the magnetic flexible layer, such as by embossing or extruding the spacer means into the bottom layer, or by using a non-conductive spacer layer similar to the one shown in FIGS. 1–4 at reference 12. By whatever spacer means utilized, the defined armature cavity houses the flexible armature so that there is enough freedom of movement to allow the flexible armature to travel about one to two millimeters, or another desired distance, before contacting the bottom layer.

A casing or other rigid structure, not shown, is usually available to provide structural support for the switch assembly, especially for the bottom layer 36. The switch layers should have an overall size that is adapted to fit into a rigid structure, such as a phone casing, so that either the outer most edges of the switch layers are securely held, or alignment structures are used to prevent the switch layers from shifting around. For normally open switches, the bottom layer may simply be a thin sheet of non-conductive material, such as a polyester film, that carries electrical conductors 54 that may be painted, printed, etched or otherwise formed. For some devices, a printed circuit board may directly function as the bottom layer. To complete a normally open switch circuit, at least that part of the bottom surface of the flexible armature 40 that will connect the electrical conductors should be electrically conductive. This may be done by simply painting or printing an electrically conductive material directly onto the bottom surface of the flexible armatures.

A user-provided actuation force 56 applied to the actuation member causes the flexible armature 40 to snap free of the magnetic coupler layer 30 and travel into the bottom layer 36. Withdrawal of the actuation force allows the magnetic coupler layer to attract the flexible armature back to the normally magnetically coupled position so that there was only a momentary affect on the logic of external electronics connected to the pushbutton switch. Because the flexible armature is connected to the magnetic flexible layer 32 at the flexible fulcrum 48, there is an additional "spring" return force created when the flexible armature is bent out of the plane of the magnetic flexible layer. When the flexible armature is displaced a considerable distance, this "spring" return force is high enough to allow overall switch travel to be increased without placing the armature out of reach of a magnetic return force.

The teachings necessary to make and use the preferred embodiment have been provided above, but there are numerous alternative designs, especially involving the electrical conductors, that follow. Combined with some basic engineering skills and some common sense, the following improvements and modifications should prove to be very helpful.

If a switch application requires that the switch be protected from its environment, here are two methods for sealing the switch. The first method is to apply a thin polyester layer over the top of the magnetic coupler layer 30, as in the prior art of FIGS. 1–4. The second method is to use a membrane switch assembly as the bottom layer 36 such that the free end 46 of each flexible armature 40 can close opposing electrical contacts formed on membranes that face each other. A suitable membrane switch assembly will typically use a thin sheet of non-conductive material, such as polyester sheeting that is about a tenth of a millimeter thick. Electrical conductors and electrical leads are printed or painted onto a surface of the thin sheet of non-conductive material, or membrane, and then the membrane is folded back onto itself so that there is a top membrane and a bottom membrane that are continuous at the fold. For each pushbutton switch, an electrical conductor on the top membrane faces an electrical conductor on the bottom membrane. The sheet usually has a ribbon lead that is used to connect the electrical leads to an appropriate ribbon connector that extends from external electronics. The membrane switch assembly additionally includes a membrane shim, also a thin sheet of non-conductive material, which normally holds the electrical conductors spaced out of electrical contact with each other. There are apertures in the membrane shim that expose the electrical conductors and define membrane armature cavities that are substantially sealed from the surrounding environment.

For a normally closed switch, the methods shown and described in U.S. Pat. No. 6,466,118, incorporated herein by reference but not limitation, may be used with the flexible armature 40 of the present invention. Electrical conductors and electrical leads may be painted or printed directly onto the top surface of the magnetic flexible layer 32 and the bottom surface of the magnetic coupler layer 30. The electrical leads can all be transferred to just one of the layers by using the magnetic attractive force between the layers to press electrical leads into electrical conductors that simply transfer a signal from one layer to the other. The top surface of the flexible armature will connect and/or carry at least one of the normally closed electrical conductors that will be opened when the pushbutton switch is actuated.

When embossing/debossing the magnetic flexible layer 32, there will be some designs that will benefit from forming the magnetic flexible layer with the magnetic coupler layer 30 magnetically coupled to it. This will result in the debossed spacers 34 being formed in both layers, making it unlikely that the layers will ever shift. Another benefit is that the embossed crown 50 will remain in precise alignment with the opening 38 in the magnetic coupler layer.

For the fewest possible layers, graphics may be printed or painted onto the top surface of the magnetic flexible layer 32 prior to having the crowns embossed into the magnetic flexible layer. The size and shape of the embossed crowns may be modified to accommodate the graphics and any ergonomics or aesthetics that are desired. As an alternative to embossed crowns, an elastomer (or polyester) overlay may be added above the magnetic coupler layer 30. The elastomer overlay should have formed buttons with centrally located actuation members that depend through the openings in the magnetic coupler layer. The elastomer overlay may be secured by a faceplate, much in the same way that many phones are constructed. In a similar fashion, hard keycaps may be used instead of embossed crowns, or plastic buttons may be insert molded to the flexible armatures. There may be situations where an overlay needs to be removable, in which case the overlay may be made from magnetic receptive rubber so that it is magnetically held against the magnetic coupler layer.

While a preferred form of the invention has been shown and described, it will be realized that alterations and modifications may be made thereto without departing from the scope of the following claims. For example, the layers of the switch assembly can be molded or formed by other means into any shape and are flexible, so a switch panel incorporating the present invention may be concave up, concave down, or otherwise made to be three dimensional. The magnetic flexible layer can be injection molded or extruded to include the cut, embossed and/or debossed features described in the preferred embodiment. Given the various uses and environments of switches, it is expected that the flexible armatures and layers of the present invention will be embossed, debossed, perforated, cut, trimmed, formed or bent into shapes that offer unique and custom switch panels that are ergonomically designed and multidimensional.

What is claimed is:

1. An electrical switch, comprising;

a magnetic coupler layer, with a top and a bottom surface, characterized by at least one opening;

a magnetic flexible layer, with a top and a bottom surface, characterized by at least one flexible armature;

a magnetic attractive force between the magnetic coupler layer and the magnetic flexible layer;

a magnetic attractive force between the magnetic coupler layer and the at least one flexible armature such that the bottom surface of the magnetic coupler layer is normally magnetically coupled to the at least one flexible armature;

at least one actuation member that is capable of passing through the at least one opening such that the at least one flexible armature may be manipulated by a switch user;

a bottom layer;

at least one debossed spacer means formed in the magnetic flexible layer so that the bottom surface of the magnetic flexible layer is substantially supported above the bottom layer to create at least one armature cavity for the at least one flexible armature; and at least one set of electrical conductors capable of switching between an electrically opened and an electrically closed position when the switch user manipulates the at least one flexible armature.

2. The electrical switch of claim 1 wherein the at least one actuation member is an embossed crown formed in the at least one flexible armature.

3. The electrical switch of claim 2 further comprising markings such as printing or painting, on that surface of the embossed crown that will be visible to the switch user.

4. The electrical switch of claim 1 further comprising an electrically conductive material that at least partially covers the at least one flexible armature, and wherein the at least one set of electrical conductors is formed on the bottom layer such that the electrical switch is electrically closed by the electrically conductive material when the switch user manipulates the at least one flexible armature away from the normally magnetically coupled position.

5. The electrical switch of claim 1 further comprising a thin sheet of durable material that is adhesively fixed to the bottom of the flexible magnetic layer before the at least one flexible armature and the at least one debossed spacer means are formed in the flexible magnetic layer.

6. The electrical switch of claim 1 wherein the at least one set of electrical conductors are arranged between the bottom surface of the magnetic coupler layer and the at least one flexible armature such that the electrical switch is electrically closed when the at least one flexible armature is in the normally magnetically coupled position.

7. The electrical switch of claim 1 wherein the bottom layer is a membrane switch assembly.

8. The electrical switch of claim 1 wherein the magnetic coupler layer and the magnetic flexible layer are substantially the same size, and these two layers are substantially housed within a casing of an electronic device such that the two layers are positioned over the bottom layer when the electronic device is fully assembled.

* * * * *